US007856774B1

(12) United States Patent
Sorkin

(10) Patent No.: US 7,856,774 B1
(45) Date of Patent: Dec. 28, 2010

(54) SHEATHING-RETAINING WEDGE ASSEMBLY FOR USE WITH A POST-TENSION ANCHORAGE SYSTEM

(76) Inventor: Felix L. Sorkin, 13022 Trinity Dr., Stafford, TX (US) 77477

( * ) Notice: Subject to any disclaimer, the term of this patent is extended or adjusted under 35 U.S.C. 154(b) by 634 days.

(21) Appl. No.: 11/861,197

(22) Filed: Sep. 25, 2007

(51) Int. Cl.
*E04C 5/08* (2006.01)

(52) U.S. Cl. ..... 52/223.13; 403/314; 403/367; 403/369; 403/374.1; 24/122.6

(58) Field of Classification Search ..... 52/223.13; 403/304, 314, 365, 367, 368, 369, 374.1; 24/122.6, 122.3, 459, 136 R, 115 M
See application file for complete search history.

(56) References Cited

U.S. PATENT DOCUMENTS 2,444,842 A * 7/1948 McConahey et al. ..... 74/24
2,699,589 A * 1/1955 Redell ..... 294/102.1
2,834,081 A * 5/1958 Stump, Jr. ..... 403/369
2,988,727 A * 6/1961 Berndt ..... 439/863
3,158,915 A * 12/1964 Olesen ..... 403/369
3,534,989 A * 10/1970 Yonkers ..... 403/369
3,596,330 A * 8/1971 Scott et al. ..... 24/122.3
3,698,749 A * 10/1972 Yonkers ..... 403/197
5,141,356 A * 8/1992 Chaize ..... 403/368
5,163,775 A * 11/1992 Rowan, Jr. ..... 403/301
5,594,977 A * 1/1997 McCallion ..... 24/136 B
5,630,301 A * 5/1997 Sieg ..... 52/223.13
5,770,286 A 6/1998 Sorkin
5,839,235 A 11/1998 Sorkin
6,098,356 A 8/2000 Sorkin
6,381,912 B1 5/2002 Sorkin
6,631,596 B1 10/2003 Sorkin
6,817,148 B1 11/2004 Sorkin

* cited by examiner

*Primary Examiner*—Brian E Glessner
*Assistant Examiner*—Adriana Figueroa
(74) *Attorney, Agent, or Firm*—Egbert Law Offices PLLC

(57) ABSTRACT

A sheathing-retaining article for use with a post-tension anchorage system has a wedge with a tendon-retaining portion and a sheathing-retaining portion. The tendon-retaining portion has a channel extending longitudinally therealong. The channel is suitable for retaining the tendon therein. The tendon-retaining portion has a tapering outer surface with a wide end at one end of the wedge and a narrow end spaced therefrom. The sheathing-retaining portion extends outwardly from the narrow end of the tendon-retaining portion. The sheathing-retaining portion engages a sheathing of a tendon extending through the channel of the wedge.

9 Claims, 2 Drawing Sheets

SHEATHING-RETAINING WEDGE ASSEMBLY FOR USE WITH A POST-TENSION ANCHORAGE SYSTEM

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to post-tension systems. More particularly, the present invention relates to wedges as used in the dead-end anchorage of such post-tension systems. More particularly, the present invention the present invention relates to anchorage assemblies which serve to retain an end of a sheathing of the tendon therein.

2. Description of Related Art Including Information Disclosed Under 37 CFR 1.97 and 37 CFR 1.98.

For many years, the design of concrete structures imitated the typical steel design of column, girder and beam. With technological advances in structural concrete, however, concrete design began to evolve. Concrete has the advantages of costing less than steel, of not requiring fireproofing, and of having plasticity, a quality that lends itself to free flowing or boldly massive architectural concepts. On the other hand, structural concrete, though quite capable of carrying almost any compressive load, is weak in carrying significant tensile loads. It becomes necessary, therefore, to add steel bars, called reinforcements, to concrete, thus allowing the concrete to carry the compressive forces and the steel to carry the tensile forces.

Structures of reinforced concrete may be constructed with load-bearing walls, but this method does not use the full potentialities of the concrete. The skeleton frame, in which the floors and roofs rest directly on exterior and interior reinforced-concrete columns, has proven to be most economical and popular. Reinforced-concrete framing is seemingly a simple form of construction. First, wood or steel forms are constructed in the sizes, positions, and shapes called for by engineering and design requirements. The steel reinforcing is then placed and held in position by wires at its intersections. Devices known as chairs and spacers are used to keep the reinforcing bars apart and raised off the form work. The size and number of the steel bars depends completely upon the imposed loads and the need to transfer these loads evenly throughout the building and down to the foundation. After the reinforcing is set in place, the concrete, comprising a mixture of water, cement, sand, and stone or aggregate and having proportions calculated to produce the required strength, is set, care being taken to prevent voids or honeycombs.

One of the simplest designs in concrete frames is the beam-and-slab. This system follows ordinary steel design that uses concrete beams that are cast integrally with the floor slabs. The beam-and-slab system is often used in apartment buildings and other structures where the beams are not visually objectionable and can be hidden. The reinforcement is simple and the forms for casting can be utilized over and over for the same shape. The system, therefore, produces an economically viable structure. With the development of flat-slab construction, exposed beams can be eliminated. In this system, reinforcing bars are projected at right angles and in two directions from every column supporting flat slabs spanning twelve or fifteen feet in both directions.

Reinforced concrete reaches its highest potentialities when it is used in pre-stressed or post-tensioned members. Spans as great as five hundred feet can be attained in members as deep as three feet for roof loads. The basic principle is simple. In pre-stressing, reinforcing tendons of high tensile strength wires are stretched to a certain determined limit and then high-strength concrete is placed around them. When the concrete has set, it holds the steel in a tight grip, preventing slippage or sagging. Post-tensioning follows the same principle, but the reinforcing tendon, usually a steel cable, is held loosely in place while the concrete is placed around it. The reinforcing tendon is then stretched by hydraulic jacks and securely anchored into place. Pre-stressing is done with individual members in the shop and post-tensioning as part of the structure on the site.

In a typical tendon tensioning anchor assembly used in such post-tensioning operations, there are provided anchors for anchoring the ends of the cables suspended therebetween. In the course of tensioning the cable in a concrete structure, a hydraulic jack or the like is releasably attached to one of the exposed ends of each cable for applying a predetermined amount of tension to the tendon, which extends through the anchor. When the desired amount of tension is applied to the cable, wedges, threaded nuts, or the like, are used to capture the cable at the anchor plate and, as the jack is removed from the tendon, to prevent its relaxation and hold it in its stressed condition.

In typical post-tension systems, the tendon is received between a pair of anchors. One of the anchors is known as the "live-end" anchor, and the opposite end is known as the "dead-end" anchor. The "live-end" anchor receives the end of the tendon which is to be tensioned. The "dead-end" anchor holds the tendon in place during the tensioning operation. Under typical operations, a plurality of wedges are inserted into an interior passageway of the anchor and around the exterior surface of the tendon. The tendon is then tensioned so as to draw the wedges inwardly into the interior passageway so as establish compressive and locking contact with an exterior surface of the tendon. This dead-end anchor can then be shipped, along with the tendon, for use at the job site.

One technique for forming such dead-end anchors is to insert the end of a tendon into the cavity of the anchor, inserting wedges into the space between the tendon and the wall of the cavity and then applying a tension force onto another end of the tendon so as to draw the wedges and the end of the tendon into the cavity in interference-fit relationship therewith. This procedure is somewhat difficult since the tendon can have a considerable length and since the use of tension forces can create a somewhat unreliable connection between the wedges and the tendon. Experimentation has found that the application of compressive force onto the end of the tendon creates a better interference-fit relationship between the wedges, the end of the tendon and the wall of the cavity of the anchor.

Another technique is described in U.S. Pat. No. 6,513,287, issued on Feb. 4, 2003 to the present inventor. This patent describes a method and apparatus for forming an anchorage of a post-tension system in which a tendon is positioned within a cavity of the anchor such that an end of the tendon extends outwardly of the cavity. A plurality of wedges are mechanically inserted within the cavity between the tendon and a wall of the cavity. Pressure is applied to an end of the tendon such that the tendon and the wedges are in interference-fit relationship within the cavity. A compression mechanism is used having a cylindrical member and a plunger extending in a channel of the cylindrical member. The wedges are attached to the cylindrical member and the cylindrical member is moved toward the cavity such that the wedges enter a space between the tendon and the wall of the cavity. The plunger applies a compressive force to the end of the tendon when the end of the tendon is in the channel of the cylindrical member.

One of the problems with conventional dead-end anchorages is that the sheathing over the tendon has a tendency to shrink over time. The shrinkage is the result of various factors. One major factor is that the sheathing is formed over the tendon in an extrusion process. As such, the polymeric material used for the sheathing is relatively hot as it exits the extrusion process. Immediately after leaving the extrusion process, the tendon, along with the sheathing, is tightly wound around a spool. During shipment, the tight winding of the tendon around the spool will mechanically resist any shrinking of the sheathing over the lubricated exterior of the steel cable on the interior of the tendon. When the cable is unwound from the spool, these mechanical forces are released. As such, as the tendon is installed in an anchor, the relaxation of these mechanical forces will generally and slowly cause the sheathing to shrink over the length of the tendon. After the tendon is connected to a dead end anchorage, the end of the sheathing will tend to the shrink slowly away from the dead end anchorage.

The problem that affects many anchorage systems is the inability to effectively prevent liquid intrusion into this area of the unsheathed portion. In normal practice, a liquid-tight tubular member is placed onto an end of the tendon so as to cover an unsheathed portion of the tendon. The tubular member slides onto and over the trumpet portion of the encapsulated anchor so as to be frictionally engaged with the trumpet portion of the anchor. The opposite end of the tubular member will include a seal that establishes a generally liquid-tight connection with the sheathed portion of the tendon.

In the past, various patents have issued to the present inventor relating to such corrosion-protection tubes. These patents were developed for the purpose of accommodating the natural shrinkage of the sheathing over the lubricated cable. For example, U.S. Pat. No. 5,839,235, issued on Nov. 20, 1998 to the present inventor, describes a corrosion protection tube for a post-tension anchor system. A tubular body is affixed in snap-fit engagement with the trumpet portion so as to extend outwardly from the trumpet portion in axial alignment therewith. The tubular body has a seal at an end opposite the trumpet portion so as to form a generally liquid-tight seal with an exterior surface of the tendon. The tubular body has a notch formed on an exterior surface thereof. The trumpet portion has an inwardly extending surface. The inwardly extending surface engages the notch so as to form a generally liquid-tight connection. A collar extends around the tubular body on a side of the notch so as to be in close relationship to the end of the trumpet portion.

U.S. Pat. No. 6,631,596, issued on Oct. 14, 2003 to the present inventor, teaches another corrosion protection tube for use on an anchor of a post-tension anchor system. This corrosion protection tube has a connection portion at one end and a sealing portion on an opposite end. The anchor has a trumpet portion with a notch extending therearound. The connection portion includes an inwardly extending surface for engagement with the notch of the trumpet portion. The sealing portion is in liquid-tight engagement with the sheathed portion of the tendon. Alternatively, the connection portion includes an additional inner sleeve so as to define an annular slot with the inwardly extending surface. The inner sleeve extends into the interior of the trumpet portion so that the inner sleeve and the trumpet portion are in a liquid-tight engagement.

U.S. Pat. No. 6,817,148, issued on Nov. 16, 2004 to the present inventor, describes another type of corrosion protection seal for the anchor of a post-tension anchor system. A seal member is affixed to an end of the tubular portion of the anchor opposite the anchor body. The seal member has a portion extending around the sheathed portion of the tendon in generally liquid-tight relationship therewith. The tubular portion has an interlock area extending therearound for engaging an interior surface of the seal member. The tubular portion has a length of generally greater than four inches extending outwardly of the anchor body.

U.S. Pat. No. 5,770,286, issued on Jun. 23, 1998 to the present inventor, shows a corrosion inhibitor retaining seal. This seal includes a cap having a tubular body and a surface extending across the of the tubular body. A corrosion-resistant material is contained within the interior area of the cap. This surface closes the end of the tubular body. A frangible area is formed on this surface The surface extends transverse to a longitudinal axis of the tubular body at one end of the tubular body. The frangible area has a thickness less than a thickness of a non-frangible remainder of the surface. The cap is formed of a polymeric material. The surface is formed of a deformable polymeric material such that the non-frangible portion of the surface forms a liquid-tight seal with an outer diameter of a tendon extending through the surface. The corrosion-resistant material is contained within the cap of a suitable volume so as to fill a void in the tubular member between the inner diameter of the tubular member and the outer diameter of a tendon extending therethrough.

U.S. Pat. No. 6,098,356, issued on Aug. 8, 2000 to the present inventor, shows a method and apparatus for sealing an intermediate anchorage of a post-tension system. This apparatus has a cap with an attachment section thereon. The attachment section is adapted to allow the cap to be connected to an end of the anchor body. The cap has a tubular member extending outwardly from the attachment section. The tubular member has an opening at an end opposite the attachment section. The cap also has a grease fitting formed thereon. The grease fitting is adapted so as to allow grease to be introduced into the interior passageway of the tubular member. The attachment section and the tubular member are integrally formed together of a polymeric material. A seal is affixed to the open end of the tubular member so as to form a liquid-tight seal over the sheathed portion of a tendon extending therethrough.

U.S. Pat. No. 6,381,912, issued on May 7, 2002 to the present inventor, also shows a method of sealing the intermediate anchor of a post-tension system. An elastomeric seal has one end affixed to the anchor member and extending outwardly therefrom. A rigid ring member is detachably received within an opposite end of the seal. The ring member has an inner diameter greater than an outer diameter of the tendon. The opposite end of the seal is in liquid-tight compressive contact with the exterior surface of the tendon when the ring member is detached from the seal. The interior passageways of the anchor, the seal and the ring member have an inner diameter, when joined together, which is larger than the outer diameter of the tendon so as to allow the anchor member, the seal and the ring member to slide along the length of the tendon.

As can be seen, there is a great deal of technology associated with this need to accommodate the shrinkage of the sheathing over the cable of the tendon of the post-tension anchor system. This technology suggests the placement of an additional tube over the polymeric encapsulation and additional materials for sealing the unsheathed portion of the tendon which extends outwardly of the anchor. In certain circumstances, these tubes are sometimes improperly installed and are simply additional components that need to be associated with the post-tension system. As such, it adds additional costs and can require additional labor associated with the installation of the sealing tube. As such, a need has developed so as to avoid the use of such a tube with the dead-end anchor of a post-tension anchor system.

Wedges that are used in dead-end anchorages have conventionally only secured the unsheathed portion of the tendon within the cavity of the anchor. These wedges have been used so as to impart a frictional engagement, under high pressures, against the outer surface of the unsheathed portion of the tendon. Typically, the unsheathed portion will extend outwardly of the anchor assembly. So as to assure that liquid intrusion does not occur, the various tubular members described hereinabove have been attached to the end of the anchorage so as to assure that the sheathed portion is in liquid-tight engagement with the anchorage. Heretofore, there have been no techniques the have retained the sheathed portion of the tendon within the cavity of the anchorage.

It is an object of the present invention to provide a wedge assembly for an anchorage system which serves to prevent the shrinkage of the sheathing of the tendon.

It is another object of the present invention to provide a wedge assembly for a dead-end anchorage which allows the end of the sheathed portion of the tendon to be engaged with the wedge assembly during the installation of the wedge assembly within the anchor.

It is a further object of the present invention to provide a wedge assembly for use with a dead-end anchorage which securely retains the end of the sheathing within the cavity of the anchor.

It is another object of the present invention to provide a wedge assembly which is easy to use, relatively inexpensive and easy to install.

These and other objects and advantages of the present invention will become apparent from a reading of the attached specification and appended claims.

BRIEF SUMMARY OF THE INVENTION

The present invention is a sheathing retaining article for use with a post-tension anchorage system. The article comprises a wedge having a tendon-retaining portion and a sheathing-retaining portion. The tendon-retaining portion has a channel extending longitudinally therealong. This channel is suitable for retaining the tendon therein. The tendon-retaining portion has a semi-circular cross-section. The tendon-retaining portion has a tapering outer surface with a wide end at one end of the wedge and a narrow end spaced away from the one end of the wedge. The sheathing-retaining portion extends outwardly from the narrow end of the tendon-retaining portion.

The sheathing-retaining portion has a channel defined therein. This channel of the sheathing-retaining portion is coaxial with the channel of the tendon-retaining portion. The tendon-retaining portion has a wall of reducing thickness extending from the wide end to the narrow end. The sheathing-retaining portion has a wall with a thickness less than the thickness of the tendon-retaining portion at the narrow end. The sheathing-retaining portion has a semi-circular cross-section.

A hook means is formed at an end of the sheathing-retaining portion opposite the tendon-retaining portion. This hook means is suitable for engaging a sheathing of a tendon extending through the channel of the sheathing-retaining portion and the tendon-retaining portion. This hook means in the preferred embodiment of the present invention, is a barbed rim formed at the end of the sheathing-retaining portion. As used herein, this "hook means" can also include various other structures. In particular, this hook means can include structures such as a wedge that is interposed between the inner surface of the sheathing and the outer surface of the tendon, a wedge interposed between the outer surface of the sheathing and the inner wall of the cavity, a pin connection extending so as to impart a positive lock to the end of the tendon, a clasp which wraps around the sheathing of the tendon within cavity and various other structures. Where a barbed rim is used, this barbed rim has an inner edge extending toward the tendon-retaining portion. The tendon-retaining portion is integral with the sheathing-retaining portion in the preferred embodiment of the present invention. Alternatively, the sheathing-retaining portion can be mechanically attached to the tendon-retaining portion or have an end juxtaposed against. The channel of the tendon-retaining portion has teeth formed thereon so as to extend transverse to the longitudinal axis of the channel.

The anchor body has a cavity formed therein. This cavity has a tapered portion with a wide end at one end of the anchor body and a narrow end interior of the cavity. The cavity has a passageway extending from the narrow end to an opposite end of the anchor body. The tapered portion receives the tendon-retaining portion of the wedge assembly therein. The passageway receives the sheathing-retaining portions of the wedge assembly therein. The passageway has a generally constant diameter extending from the narrow end of the tapered portion of the cavity. The outer surfaces of the wedges are juxtaposed against the tapered portion of the cavity. The sheathing-retaining portions are juxtaposed against a wall of the passageway. A tendon extends through the cavity of the anchor body. This tendon has a sheathed portion and an unsheathed portion. The sheathed portion extends into the passageway. The sheathing-retaining portions of the wedges are engaged with the sheathed portion of the tendon. The unsheathed portion of the tendon is engaged with the tendon-retaining portions of the first and second wedges. The sheathing-retaining portion of the wedges are interposed between the sheathed portion and a wall of the passageway.

DETAILED DESCRIPTION OF THE INVENTION

Figure 1:
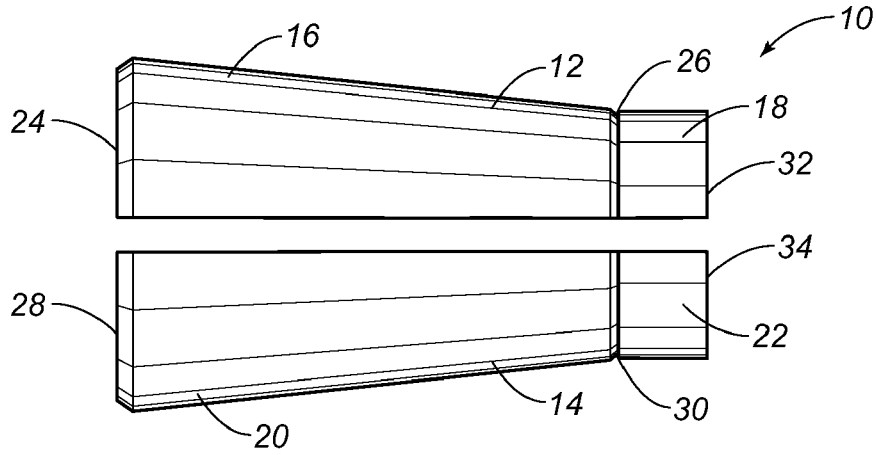
FIG. 1 is a side elevation view of the wedge assembly of the preferred embodiment of the present invention.

Referring to FIG. 1, there is shown the wedge assembly 10 in accordance with preferred embodiment of the present invention. Wedge assembly 10 includes a first wedge 12 and a second wedge 14. Each of the wedges 12 and 14 will face each other. The first wedge 12 includes a tendon-retaining portion 16 and a sheathing-retaining portion 18. The second wedge 14 also includes a tendon-retaining portion 20 and a sheathing-retaining portion 22. As can be seen the outer surface of the tendon-retaining portion 16 has a wide diameter at the end 24 and a narrow diameter 26 spaced away from the end 24. Similarly, the second wedge 14 has a wide diameter at end 28 and a narrow diameter 30 spaced away from the end 28. The opposite end 32 of the first wedge 12 has a diameter generally matching the diameter at the narrow end 26 of the tendon-retaining portion 16. Similarly, the end 34 of the sheathing-retaining portion 22 of the second wedge 14 has a diameter similar to the diameter of the tendon-retaining portion 20 of the second wedge 14 at the narrow diameter 30. Both the tendon-retaining portions 16 and 20 and the sheathing-retaining portions 18 and 22 have a generally semi-circular outer surface.

Figure 2:
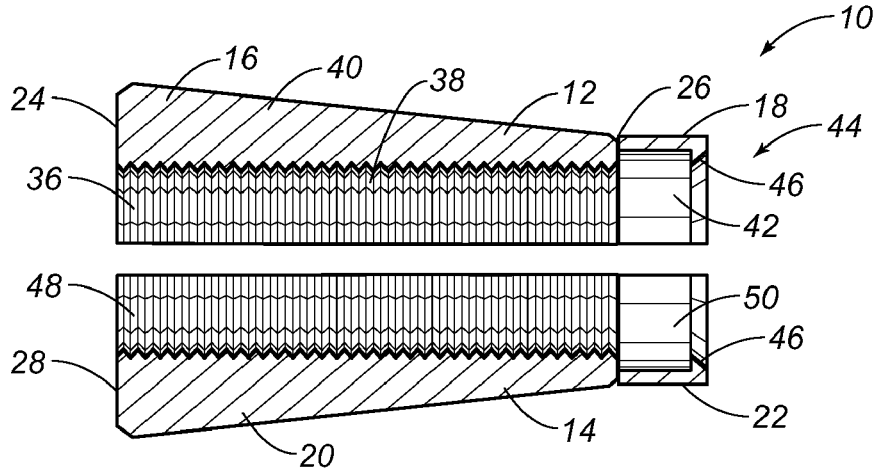
FIG. 2 is a cross-sectional view of the wedge assembly of the present invention.

FIG. 2 shows the cross-section of the wedge assembly 10. With reference to the first wedge 12, it can be seen that there is a channel 36 extending through the interior thereof. This channel 36 has teeth 38 formed thereon. The teeth 38 extend transverse to the longitudinal axis of the channel 36. The wall 40 of the first wedge 12 has a thickness that enlarges from end 24 to the narrow end 26. The sheathing-retaining portion 18 of the first wedge 12 also has a channel 42 extending coaxial with the channel 36 of the tendon-retaining portion 16. The sheathing-retaining portion 18 has a wall thickness that is less than the thickness of the wall 40 of the tendon-retaining portion 16 at the narrow end 26. A hook means 44 is formed at the end of the sheathing-retaining portion 18 opposite the tendon-retaining portion 16. This hook means is in the form of a barb 46 that extends as a barbed rim around the end of the sheathing-retaining portion 18. The second wedge 14 is symmetrical with the shape and construction of the first wedge 12. The channel 48 of the second wedge 14 will face the channel 38 of the first wedge 12. Similarly, the channel 50 of the sheathing-retaining portion 22 of the second wedge 14 will face the channel 42 of the sheathing-retaining portion 18 of the first wedge 12. The sheathing-retaining portion 22 of the second wedge 14 also has a barbed rim 46 formed at the end thereof opposite the tendon-retaining portion 20.

Figure 3:
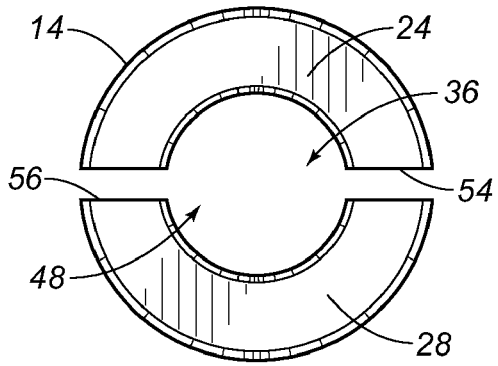
FIG. 3 is an end view of the wedge assembly of the preferred embodiment of the present invention.

FIG. 3 shows a view at the ends 24 and 28 of the first wedge 12 and the second wedge 14. As can be seen, the channel 36 of the first wedge 12 will face the channel 48 of the second wedge 14. Each of the wedges 12 and 14 is generally aligned with each other. As the gap between the end surfaces 54 and 56 closes together, the wedges 12 and 14 will strongly grasp a tendon passing through the channels 36 and 48.

Figure 4:
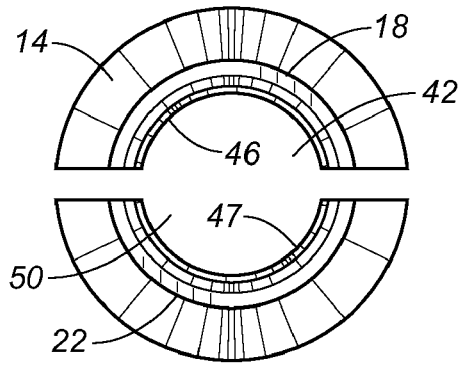
FIG. 4 is an opposite end view of the wedge assembly of the present invention.

FIG. 4 shows the opposite end of the wedges 12 and 14. In particular, the barbed rim 46 of the wedge 12 and the barbed rim 47 of the second wedge 14 extend inwardly into the respective channels 42 and 50 of the sheathing-retaining portions 18 and 22. The barbed rims 46 and 47 will serve to engage with the sheathing of a tendon received within the channels 42 and 50. In particular, as the gap between the end edges of each of the sheathing-retaining portions 18 and 22 is brought closer together, the barbed rims 46 and 47 will strongly bite into the material of the sheathing of a tendon so as to fix the position of the sheathed portion of the tendon therein.

Figure 5:
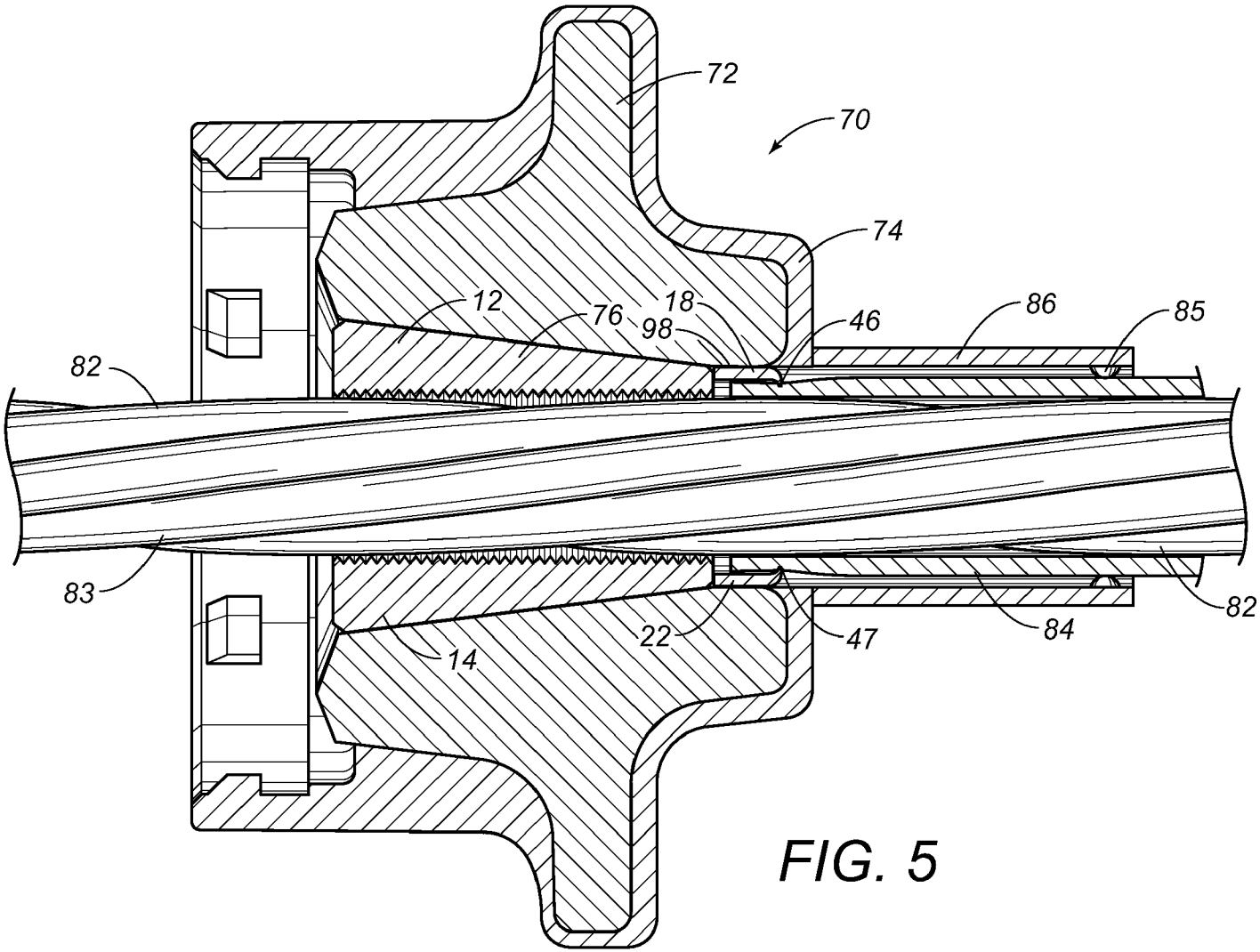
FIG. 5 is a cross-sectional view showing the wedge assembly of the preferred embodiment of the present invention as installed with an anchorage system.

FIG. 5 shows the installation of the wedge assembly 10 within a dead-end anchorage assembly 70. The dead-end anchorage assembly includes an anchor body 72 in the form of a steel anchor. A polymeric encapsulation extends around the steel anchor 72 so as to isolate the steel anchor 72 from the outside elements. A cavity 76 extends through the interior of the steel anchor 72. The cavity 76 is suitably tapered so as to have a wide end at one end of the anchor body 72 and a narrow end of the cavity 76 interior of the anchor body 72. A passageway 98 extends from the narrow end of the cavity 76 to the opposite end of the anchor body 72. The passageway 98 has a generally constant diameter extending from this narrow end. The tapered configuration of the cavity 76 allows the wedges 12 and 14 to be inserted therein. When forces are applied to the tendon 82, or to the wedges 12 and 14, the wedges 12 and 14 will move in sliding relationship within the tapered portion of the cavity 76 so as to strongly grip the unsheathed portion 83 of tendon 82. The tendon 82 also has a sheathed portion extending thereover. The sheathed portion 84 has an end which resides within the passageway 98 of the cavity 76. The sheathing 84 will also extend outwardly of the opposite end of the anchor body 72 and along the interior of a trumpet 86 formed of the polymeric encapsulation 74. Trumpet 86 extends for a length beyond the opposite end of the anchor body 72 so as to overlie the sheathing 84 extending along the tendon 82. A seal 85 is affixed within the interior of the trumpet 86 so as to engage with the sheathing 84 of the tendon 82. As such, seal 85, in the nature of an annular seal, effectively prevents liquid intrusion into the interior of the anchorage 70.

As can be seen in FIG. 5, the sheathing-retaining portions 18 and 22 extend into the passageway 98 of the anchor body 72. The barbed rims 46 and 47 engage with the sheathing 84 in a positive manner. In particular, the barbed rims 46 and 47 will bite into the surface of the sheathing 84 so as to fix a position of the sheathing 84 within the passageway 98. As such, the wedge assembly of the present invention effectively assures that the end of the sheathing 84 is retained positively within the wedge cavity 76 of the anchor body 72.

In the present invention, during installation, the wedges 12 and 14 are inserted into the wedge cavity 76. While the wedges 12 and 14 slide along the tapered cavity 76 into position, the sheathing-retaining portions 18 and 22 will slide along the wall of the passageway 98. When reaching a termination point, the barbed rims 46 and 47 will engage with the sheathing 84. Since the wall thicknesses of the sheathing-retaining portions 18 and 22 are relatively thin, they will deflect somewhat while the wedges 12 and 14 are passed across the transition corner between tapered portion of the cavity 76 and the constant diameter passageway 84. This deflection serves to further urge the barbed rims 46 and 47 into engagement with the material of the sheathing 84. Since the force of shrinkage of the sheathing 84 on the tendon 82 is only 100 to 125 p.s.i., the relatively thin walled sheathing-retaining portions 18 and 22, along with their barbed rims 46 and 47, can effectively overcome this pressure of sheathing shrinkage. This is particularly true since the force required to apply to wedges 12 and 14 is approximately 30,000 p.s.i. Even if the barbed rims 46 and 47 do not effectively bite into the material of the sheathing 84, the compression forces of forcing the sheathing-retaining portions 18 and 22 into the spacing between the sheathing and the wall of the passageway 98 will create an interference-fit relationship between the sheathing 84 and the wall of passageway 98. This further serves to retain the end of the sheathing 84 within the passageway 98.

In the configuration of the wedge set of the present invention, the wedge set can be formed as an integral structure. As such, only a pair of wedges 12 and 14 are required in order to accomplish both the task of retaining the unsheathed portion of the tendon 82 and of retaining the sheathed portion 84 of the tendon 82. This can be accomplished in a single installation procedure. In other circumstances where the sheathing-retaining portions 18 and 22 are detachable from the ends of the tendon-retaining portions 12 and 14, the end surface of the wedges 12 and 14 can simply push the sheathing-retaining portions 18 and 22 into position during installation. As such, it can be seen that installation can be accomplished in a very simple, efficient and cost-effective manner.

Since the sheathing 84 is retained within the passageway 98 of anchor body 72, the annular seal 85 is very effective in preventing liquid intrusion. No further corrosion-protection tubes are necessary so as to prevent liquid intrusion. Furthermore, the close juxtaposition of the sheathing-retaining portions 18 and 22 against the wall of passageway 98 and the engagement with the sheathing 84 will provide a further barrier against liquid intrusion into the cavity 76. As a result, the costs associated with the providing the corrosion protection tubes over or under the trumpet 86 are avoided. The shrinkage of the sheathing 84 is no longer a factor that needs to be accommodated in the design of such dead-end post-tension anchorage system.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A sheathing-retaining wedge assembly for use with a post-tension anchorage system, the wedge assembly comprising:

a first wedge having a tendon-retaining portion and a sheathing-retaining portion, said tendon-retaining portion having a channel extending longitudinally therealong, said channel suitable for retaining the tendon therein, said tendon-retaining portion having a semi-circular cross-section, said tendon-retaining portion having a tapering outer surface with a wide end at one end of said wedge and a narrow end spaced away from said one end of said first wedge, said sheathing-retaining portion extending outwardly from said narrow end of said tendon-retaining portion of said first wedge; and a second wedge having a tendon-retaining portion and a sheathing-retaining portion, said tendon-retaining portion of said second wedge having a channel extending longitudinally therealong, said channel of said tendon-retaining portion of said second wedge suitable for retaining the tendon therein, said tendon-retaining portion of said second wedge having a semi-circular cross section, said tendon-retaining portion of said second wedge having a tapering outer surface with a wide end at one end of said second wedge and a narrow end spaced away from said one end of said second wedge, said sheathing-retaining portion of said second wedge extending outwardly from said narrow end of said tendon-retaining portion of said second wedge, said second wedge having a shape symmetrical with said first wedge;

an anchor body having a cavity formed therein, said cavity having a tapered portion with a wide end at one end of said anchor body and a narrow end interior of said cavity, said cavity having a passageway extending from said narrow end to an opposite end of said anchor body; and a tendon extending through said cavity of said anchor body, said tendon having a sheathed portion and an unsheathed portion, said sheathed portion extending into said passageway, said sheathing-retaining portions of said first and second wedges engaged with said sheathed portion of said tendon, said unsheathed portion of said tendon engaged with said tendon-retaining portions of said first and second wedges.

2. The wedge assembly of claim 1, said sheathing-retaining portion of said first wedge having a channel defined therein, said channel of said sheathing-retaining portion of said first wedge being coaxial with said channel of said tendon-retaining portion of said first wedge, said sheathing-retaining portion of said second wedge having a channel defined therein, said channel of said sheathing-retaining portion of said second wedge being coaxial with said channel of said tendon-retaining portion of said second wedge, said channel of said sheathing-retaining portion of said first wedge facing said channel of said sheathing-retaining portion of said second wedge.

3. The wedge assembly of claim 1, said tendon-retaining portion of said first wedge having a wall of reducing thickness extending from said wide end to said narrow end of said first wedge, said sheathing-retaining portion of said first wedge having a wall with a thickness less than the thickness of said tendon-retaining portion at said first wedge at said narrow end, said tendon-retaining portion of said second wedge having a wall of reducing thickness extending from said wide end to said narrow end of said second wedge, said sheathing-retaining portion of said second wedge having a wall with a thickness less than the thickness of said tendon-retaining portion of said second wedge at said narrow end.

4. The wedge assembly of claim 1, said sheathing-retaining portion of said first wedge having a hook means formed at an end opposite said tendon-retaining portion of said first wedge, said first hook means for engaging a portion of a sheathing of a tendon extending through said channel of said sheathing-retaining portion and said tendon-retaining portion of said first wedge, said sheathing-retaining portion of said second wedge having a second hook means formed at an end opposite said tendon-retaining portion of said second wedge, said second hook means for engaging another portion of the sheathing of the tendon extending through said channel extending through said channel of said sheathing-retaining portion and said tendon-retaining portion of said second wedge.

5. The wedge assembly of claim 4, each of said first and second said hook means comprising a barbed rim formed on the end of said sheathing-retaining portion.

6. The assembly of claim 1, said tapered portion receiving and tendon-retaining portion of said first and second wedges therein, said passageway receiving said sheathing-retaining portion of said first and second wedges therein.

7. The assembly of claim 6, said passageway having a generally constant diameter extending from said narrow end of said tapered portion of said cavity.

8. The assembly of claim 7, said outer surface of said first and second wedges being juxtaposed against a wall of said tapered portion of said cavity, said sheathing-retaining portion being juxtaposed against a wall of said passageway.

9. The assembly of claim 1, said sheathing-retaining portion of said first and second wedges being interposed between said sheathed portion and a wall of said passageway.

* * * * *